United States Patent [19]

Leader

[11] Patent Number: 4,754,774

[45] Date of Patent: Jul. 5, 1988

[54] COLLAPSIBLE SHELTER

[75] Inventor: Ashley Leader, Bateman, Australia

[73] Assignee: Equipment Design Services Pty., Ltd., Perth, Australia

[21] Appl. No.: 927,644

[22] Filed: Nov. 5, 1986

[51] Int. Cl.[4] ..... E04H 15/06; E04H 15/00; E04F 10/06

[52] U.S. Cl. ..... 135/88; 160/66; 135/120

[58] Field of Search ..... 135/88, 89, 96, 98, 135/102, 103, 104, 106, 117, 120, DIG. 9; 160/58, 66, 114, DIG. 4

[56] References Cited

U.S. PATENT DOCUMENTS

| | | | |
|---|---|---|---|
| Re. 30,664 | 7/1981 | Upton et al. | 160/66 |
| 1,483,741 | 2/1924 | Moffett | 135/88 |
| 1,719,055 | 7/1929 | Herzer | 135/88 |
| 1,918,423 | 7/1933 | Persinger | 135/88 X |
| 2,066,078 | 12/1936 | Schmeiser | 135/88 |
| 2,107,608 | 2/1938 | Hewlett | 160/66 |
| 2,568,048 | 9/1951 | Arnold | 135/89 X |
| 2,583,824 | 1/1952 | Dwinell et al. | 160/66 X |
| 2,788,791 | 4/1957 | Pospisil et al. | 135/106 X |
| 2,858,837 | 11/1958 | Harper | 135/88 X |
| 3,040,756 | 6/1962 | Zerbe | 135/106 X |
| 3,469,589 | 9/1969 | Mitchell | 135/88 X |
| 3,697,123 | 10/1972 | Gygrynuk | 135/89 X |
| 3,707,977 | 1/1973 | Grady | 135/88 |
| 3,923,336 | 12/1975 | Price, Sr. | 135/88 X |
| 3,968,809 | 7/1976 | Beavers | 135/88 |
| 4,188,964 | 2/1980 | Greer | 135/89 |

FOREIGN PATENT DOCUMENTS

| | | | |
|---|---|---|---|
| 3524343 | 7/1986 | Fed. Rep. of Germany | 160/66 |
| 535976 | 11/1957 | Italy | 135/88 |

*Primary Examiner*—Robert A. Hafer
*Assistant Examiner*—D. Neal Muir
*Attorney, Agent, or Firm*—Harness, Dickey & Pierce

[57] ABSTRACT

A collapsible structure adapted to be mounted on a supporting base such as a motor vehicle. The collapsible structure includes a roller journalled on a supporting structure and to which one end of a flexible roof panel is secured for rolling and unrolling. A supporting structure including a frame comprising a pair of transversely spaced tracks provide a guide for supporting guide members carried at the ends of the roof panel for assisting in its rolling and unrolling operation.

12 Claims, 8 Drawing Sheets

COLLAPSIBLE SHELTER

BACKGROUND OF THE INVENTION

This invention relates to a collapsible shelter and is particularly applicable to a collapsible shelter which can be stored in a housing structure mounted on a vehicle and which can be erected alongside the vehicle.

It is known to provide collapsible shelters, particularly in the form of tents, which can be stored in a housing structure mounted on top of a motor vehicle and which can be erected alongside the motor vehicle. These collapsible shelters generally comprise a collapsible frame structure which can be erected alongside the vehicle and a flexible covering which can be fitted over the frame structure. Generally, the flexible covering is permanently attached to a roller mounted within the housing whereby the flexible covering is wound upon the roller for storage in the housing and unwound therefrom for erection of the shelter.

These known collapsible shelters have not proved altogether satisfactory because of the difficulty in getting the covering to roll upon the roller in a neat and compact manner. This is particularly so with collapsible shelters which are in the form of tents having flexible panels defining a roof and side walls with the latter being arranged for the purposes of storage to be folded onto the roof whereby the flexible covering is in a folded pile which can then be wound upon the roller. The necessity for the flexible covering to wind neatly and tautly upon the roller for compact storage provides a limitation to the ease with which these known collapsible shelters may be disassembled for storage purposes.

The present invention seeks to provide a collapsible shelter which can be quickly and easily erected and disassembled.

SUMMARY OF THE INVENTION

Broadly, the invention resides in a collapsible shelter mountable on a supporting structure such as a motor vehicle, the collapsible shelter comprising a roller mountable on the supporting structure, a roof panel of flexible material secured at one end to the roller whereby upon rotation of the roller the roof panel is windable upon the roller for storage and unwindable from the roller to extend outwardly of the support structure and define a roof, guide means for guiding the roof panel while being wound upon and from the roller, wherein the guide means includes a track means and an engaging means provided on the roof panel adjacent the outer edge thereof, the track means having a collapsed condition and an erected condition wherein when in the erected condition the track means extends outwardly of the roller, the engaging means being engagable with the track means for guided movement therealong when the track means is in the erected condition thereby to guide the roof panel while being wound upon and from the roller, the track means being angularly adjustable when in the erected condition whereby to facilitate selective variation of the vertical position of the end thereof remote from the roller.

With this arrangement, said end of the track means (being the outer end of the track means) can be lowered to facilitate access to the region above the track means. This is particularly useful in circumstances where the shelter has one or more side wall panels which for storage purposes are foldable onto the roof panel to create a folded pile of panels. By lowering the outer end of the track means, the folded pile is readily accessible during erection and disassembly of the shelter.

The collapsible shelter according to the invention may be simply in the form of an awning but is preferably in the form of a tent having side panels as mentioned hereinbefore.

The roller is preferably mounted within a housing having mounting means for detachable mounting on a motor vehicle. In this condition, the collapsible shelter is partially supported by the motor vehicle when erected and is stored in the housing on the motor vehicle when in the collapsed condition. It is further preferred that the housing can be detached from the motor vehicle when the shelter is erected, thus providing shelter while permitting separate use of the motor vehicle.

The collapsible shelter includes a collapsible frame structure for erection immediately adjacent the supporting structure, the collapsible frame structure when so erected giving form or shape to the roof panel when unwound from the roller, the track means preferably being defined by a pair of elongate roof support members which form part of the frame structure and which in use are disposed each adjacent a respective side edge of the roof panel.

Preferably, the outer end of each elongate roof support member is in use supported by a support pole forming part of the frame structure, the pole being adjustable in length.

Preferably, the inner end of each elongate roof support member is detachably connectable to a pivot means located adjacent the roller.

Preferably, the engaging means comprises a pair of engaging members to each slidably engage one of the elongate roof support members.

Preferably, an elongate bracing element is attached to the outer end of the roof panel thereby to provide lateral rigidity thereto.

Preferably a winding mechanism is provided for rotating the roller in the direction corresponding to winding of the roof panel upon the roller. It is preferred that the winding mechanism is a spring loaded mechanism whereby the roller is biassed towards a retracted position in which the roof panel is wound about the roller, a retaining means being provided for retaining the roof panel in an unwound position against the resistance of the spring loaded roller.

Preferably, the collapsible shelter further comprises a side panel of flexible material attached to an edge of the roof panel, the side panel being movable between stowed and operative positions wherein in the stowed position the side panel lays in face-to-face relation with the roof panel and wherein in the operative position the side panel provides the side wall, the inner edge of the side panel being adapted to be detachably secured to the roller.

This arrangement ensures that the inner edge of the side panel winds about the roller with the roof panel.

The inner edge of the side panel may be provided with a securing flap which is adapted to be partially wrapped about the roller and releasably fixed thereto. In addition, the inner edge of the side panel may be provided with a tucking flap which is adapted to be partially wrapped about the roller and tucked into the region between the roller and the roof panel.

Preferably the side panel is detachably securable to the roof panel when in the stowed position so as to maintain it in face-to-face relation therewith during winding upon and unwinding from the roller. It is further preferred that the side panel is maintained in a relatively taut condition so as to facilitate compact storage.

The collapsible shelter may be provided with one or more further side panels. For instance, there may be three side panels in circumstances where the shelter is intended for use as a tent to be erected alongside a vehicle such as a campervan or caravan so as to function as an annexe therefor. In these circumstances, two of the side panels would provide the two side walls of the tent and the third side panel would provide the front wall, the rear of the tent being formed by part of the vehicle. With this arranged, the side panel which is adapted to be detachably secured to the roller would be the uppermost panel of the folded side panels overlaying the roof panel. One or more of the other side panels may also be adapted to be detachably secured to the roller if desired.

BRIEF DESCRIPTION OF THE DRAWINGS.

The invention will be better understood by reference to the following description of one specific embodiment thereof as shown in the accompanying drawings in which.

Figure 1:
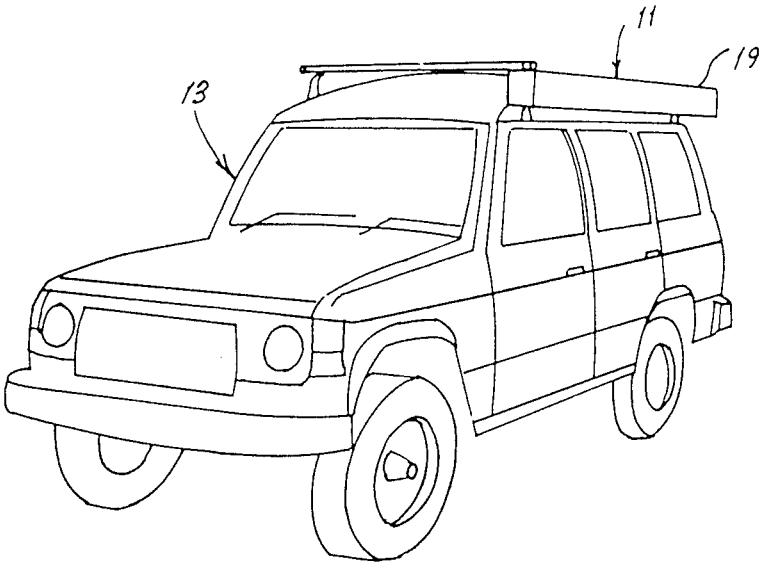
FIG. 1 is a perspective view of a shelter according to the embodiment mounted in a motor vehicle, the shelter being shown in a stowed condition.

DETAILED DESCRIPTION OF THE PREFERRED EMBODIMENT OF THE INVENTION.

The embodiment shown in the drawings is directed to a collapsible shelter 11 which is adapted to be transported on top of a motor vehicle 13 and which can be erected alongside the vehicle so as to provide a tent which functions as an annexe for the vehicle.

The collapsible shelter 11 comprises a flexible covering of canvas or other waterproof sheet material and a collapsible frame structure 17 which when assembled gives form or shape to the flexible covering thereby to provide the tent.

Figure 2:
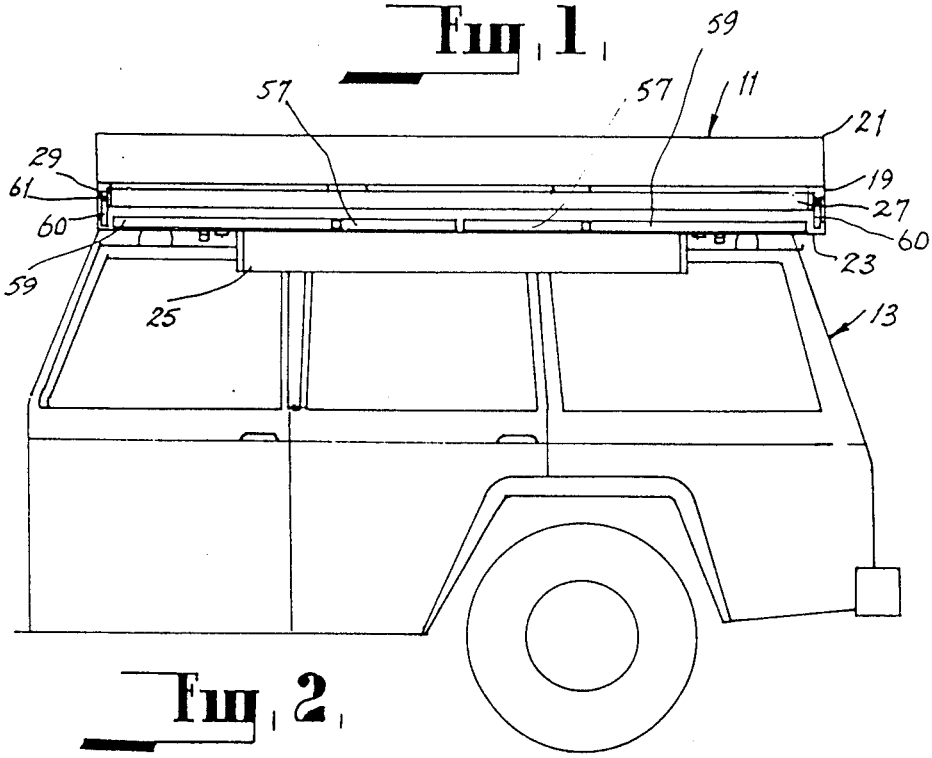
FIG. 2 is a fragmentary elevational view showing the shelter still in the stowed condition but with the storage compartment open.

The collapsible shelter 11 further includes an elongate housing 19 which is adapted to be releasably mounted along one side of the vehicle 13 adjacent the roof thereof. The housing 19 has a hollow interior thereby to define a compartment for storage of the flexible covering and the various parts of the frame structure when in the collapsed condition. The outwardly facing side wall of the housing is in the form of a hinged cover 21 which may be raised to provide access to the interior of the housing. The housing 19 has a bottom wall 23 which incorporates a hinged portion 25 which may be swung downwardly (as shown in FIG. 2) to provide access to the compartment from the underside, the purpose of which will become apparent hereinafter.

A roller 27 is rotatably mounted within the compartment and is supported at its ends on mounting brackets 29. The roller 27 incorporates a spring winding mechanism for automatic return of the roller to its original position after being wound.

Figure 3:
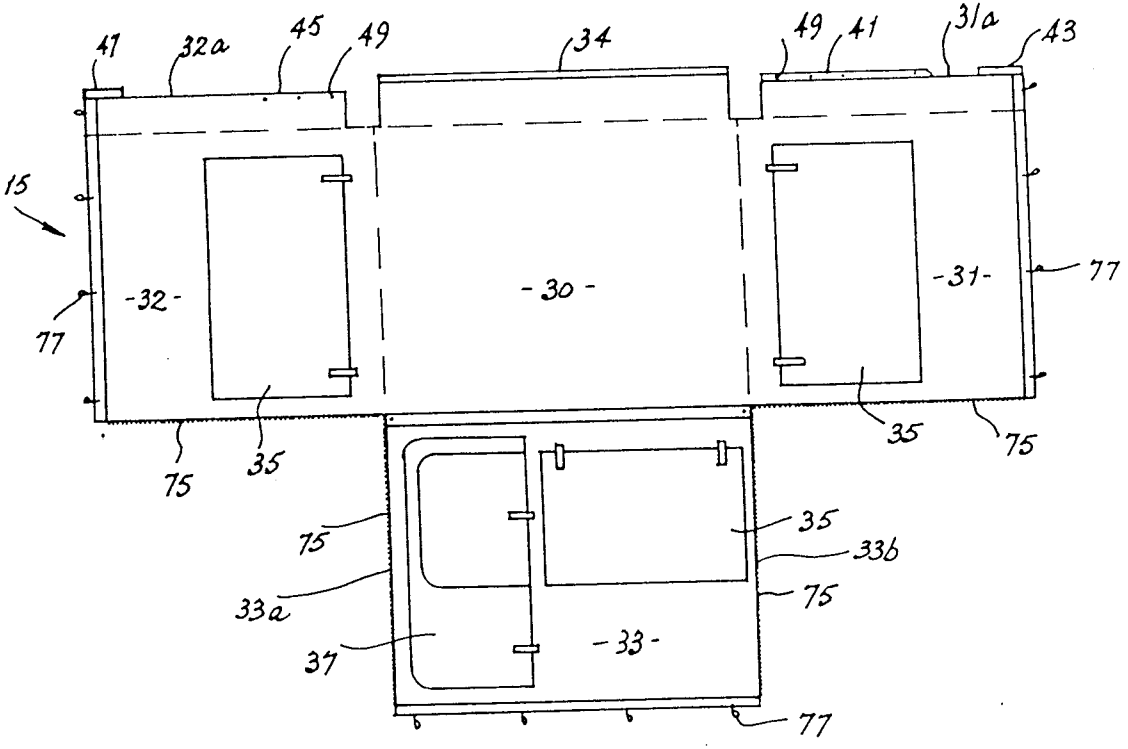
FIG. 3 is a development of a flexible covering forming part of the shelter.

The flexible covering 15 is shown in a developed form in FIG. 3 and includes a substantially rectangular roof panel 30, and first, second and third side panels 31, 32 and 33 respectively each attached to a respective one side edge of the roof panel. An attaching flap 34 is provided at the remaining edge of the roof panel.

The flexible covering is permanently attached to the roller 27 whereby it can be wound upon the roller into a retracted condition for storage purposes and can be unwound therefrom into an extended condition for erection of the shelter. The flexible covering 15 is attached to the roller 27 by means of the attaching flap 34 which is permanently wrapped around the roller and is secured at its free edge to the roller.

The junction between the roof panel 30 and each side panel defines a fold line about which the respective side panel may be folded into a stowed position in which it overlays the roof panel in a taut condition. In this way, the flexible covering 15 assumes a folded condition in which the side panels are piled one upon another on top of the roof panel. Fastening means (not shown) such as press-studs are provided for releasably securing each side panel to the panel below it in the folded pile, so as to retain it in position.

The side panels incorporate closable openings 35 which provide for windows in the shelter. The third side panel also has a closable opening 37 which provides an accessway into and out of the shelter.

For compact storage, the folded flexible covering 15 should wind neatly and tautly onto the roller. The taut condition of the folded side panels assists in this respect. To further assist, it is advantageous to releasably secure the inner edge of at least the particular side panel which is uppermost in the folded pile of panels to the roller so as to lead the folded flexible covering onto the roller at the commencement of the winding operation. In this embodiment the first side panel is uppermost in the folded pile and both its inner edge 31*a* and that of the second side panel 32*a* are adapted to be detachably secured to the roller. The third side panel 33 is below both the first and second side panels and because of this and the fact that its corresponding edge terminates short of the inner edges of the other two side panels, there is no real benefit in securing it to the roller.

Figure 14:
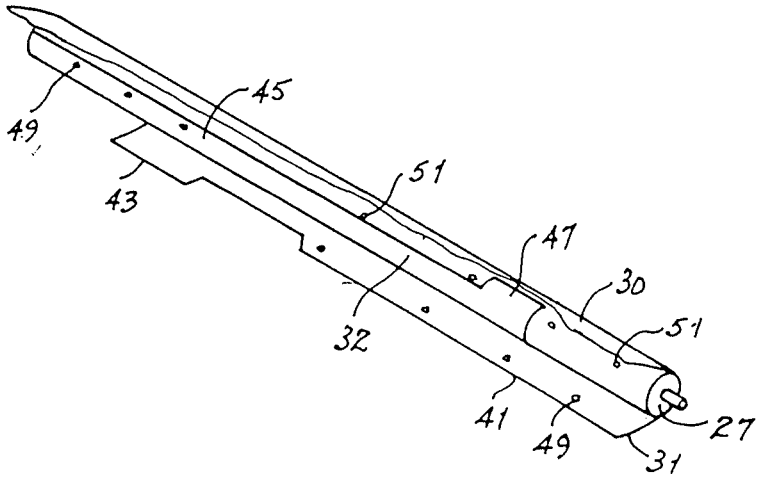
FIG. 14 is a fragmentary perspective view showing the roller and the flexible covering attached thereto.
Figure 6:
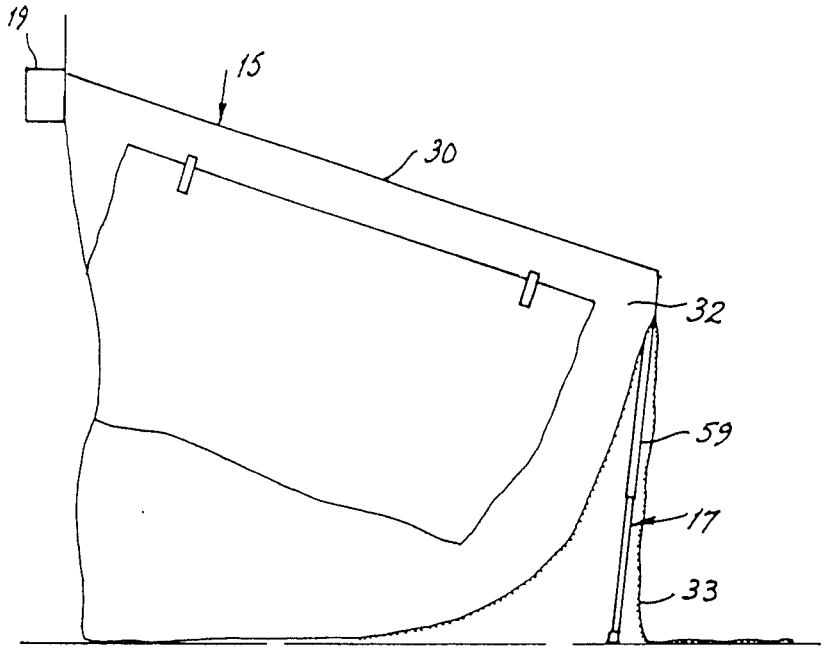
FIG. 6 is a side elevational view of the shelter at a still further stage of erection thereof (with the motor vehicle omitted)

To facilitate securement of the inner edge 31*a* of the first side panel 31 to the roller, there is provided a securing flap 41 and a tucking flap 43 at that inner edge, as best seen in FIG. 3. Likewise, to facilitate securement of the inner edge 32*a* of the second side panel 32 to the roller, there is provided a securing flap 45 and a tucking flap 47 at that inner edge, also as best seen in FIG. 3. The securing flaps 41 and 45 each have a plurality of spaced fastening elements 49 which are arranged to co-operate with complementary fastening elements 51 on the roller 27 thereby to detachably fasten the respective securing flap to the roller when the securing flap is wrapped around the roller. The complementing fastening elements 51 are, more particularly, attached to the attaching flap 34 which is permanently wrapped around the roller. The co-operating fastening elements 49 and 51 are conveniently in the form of press-stud assemblies but may be in any other suitable form. The tucking flaps 43 and 47 are each tucked between the roof panel 30 and the roller 27. This arrangement is illustrated in FIG. 14 which shows the securing flap 45 of the second side panel 32 secured to the roller 27 and the tucking flap 47 also in position. The securing flap 41 and tucking flap 43 of the first side panel 31 are shown in a position in which they are separated from the roller.

The hinged portion 25 in the bottom wall 23 of the housing 19 provides easy access to the roller 27 for the purpose of fixing or removing the securing and tucking flaps.

Attached to the outside or leading edge of the roof panel and extending along the length thereof is an elongate bracing member 53 having a depending portion 54 at its leading edge. The bracing member 53 provides lateral rigidity to the leading edge of the roof panel. Gripping handles 55 are mounted on the bracing member for grasping the flexible covering to facilitate winding of the flexible covering upon and unwinding thereof from the roller.

The frame structure 17 is adapted to be erected alongside the vehicle 13 to give form and shape to the flexible covering 15. The frame structure 17 includes a pair of elongate roof members 57 one end 57*a* of each of which is adapted to be supported adjacent to a respective end of the roller 27 and the other end 57*b* of which is adapted to be supported on the upper end of a ground engaging pole 59. Said one end 57*a* (being the inner end) of each elongate roof member 57 is adapted to locate on a spigot 60 which is pivotally mounted on a bracket 61 located within the housing 19. More particularly, the spigot 60 is mounted on a hinge pin 62 which is attached to the bracket 61. A spring-loaded locating pin 64 extends through a hole in the side wall of the spigot 60 and is adapted to locate in an opening in the elongated roof member 57 when the latter is in position on the spigot. The pin provides positive engagement between the elongate roof member and the spigot.

The pivotal action of the spigots permit the inclination of the elongate roof members 57 to be selectively adjusted. The poles 59 which support the outer ends of the roof members 57 are each of adjustable length thereby to accommodate the selective inclination of the elongate roof members.

In addition to serving as part of the frame structure 17, the elongate roof members 57 provide a track for guiding the folded flexible covering between its extended and retracted conditions. For this purpose, at each end of the bracing member 53 there is provided an engaging member 63 which is adapted to engage the respective elongate roof member 57 for sliding movement therealong. Each engaging member 63 comprises a pair of spaced sliders 65 formed of low friction material such as nylon. The sliders 65 of each member 63 straddle the elongate roof member 57 so as to resist lateral movement while permitting movement along the elongate roof member.

Figure 13:
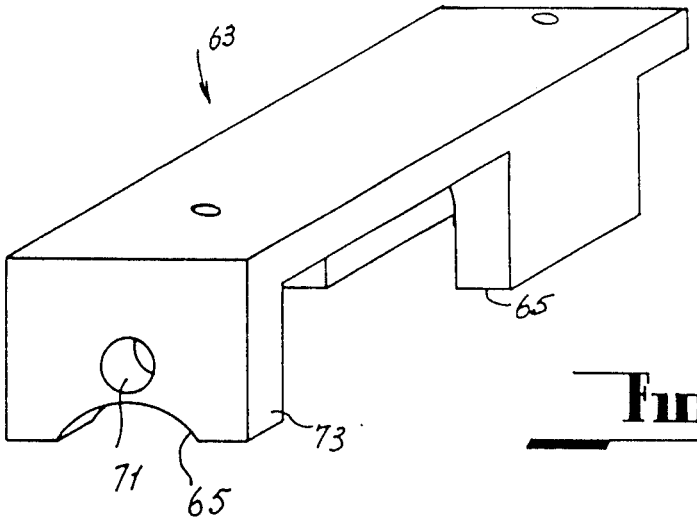
FIG. 13 is a perspective view of an engaging member from sliding engagement with one of the elongate roof members.
Figure 12:
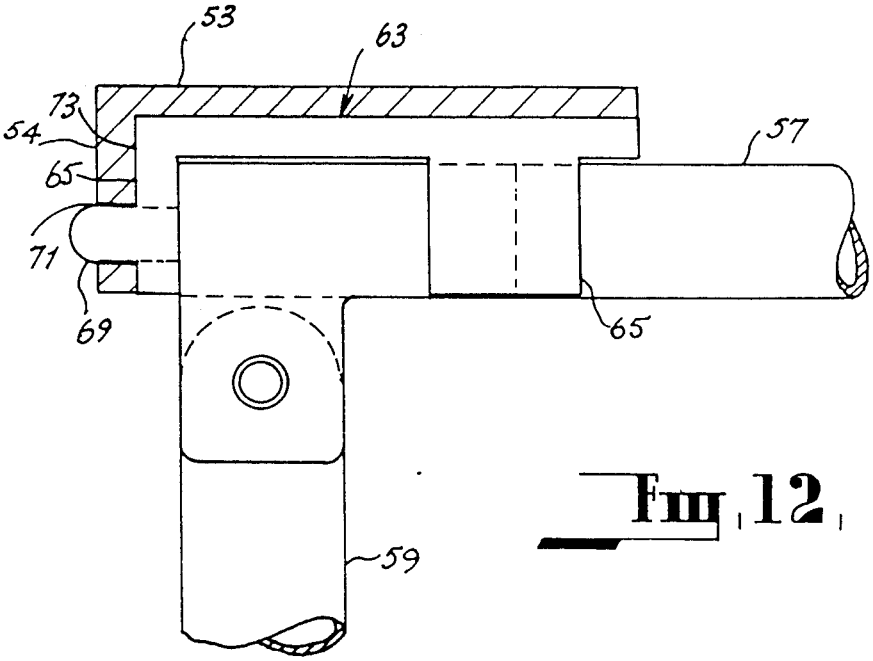
FIG. 12 is a detailed view at the other end of the elongate roof member of FIG. 11.

A retaining means is provided for retaining the flexible covering in the extended condition against the action of the spring loaded roller 27. The retaining means includes a latch pin 69 projecting axially from the outer end of each elongate roof member and a latch aperture 71 defined by aligned holes formed in a depending portion 73 at the leading end of the engaging member 63 and in the depending portion 54 at the leading edge of the bracing member 53. The leading slider 65 is provided on the underside of the depending portion, as best seen in FIG. 13. As the folded flexible covering 15 approaches its fully extended condition, the depending portion 73 carries beyond the end of the respective elongate roof member 57 and drops down over that end into a position in which the latch pin 69 projecting from the elongate roof member locates in the latch aperture 71, as shown in FIG. 12. When received in its latch aperture 71, each latch pin 69 serves to retain the flexible covering in the extended condition against the return force applied to it by the roller.

As mentioned hereinbefore, it is necessary to fold the flexible covering 15 in order to permit it to be wound onto the roller 27. In this connection, the third side panel 33 is folded about its respective fold line so as to overlay the roof panel 30. The third side panel 33 is fastened to the roof panel in this overlaying position by means the detachable fastening means (not shown) which maintain the overlying sheet in a taut condition. The second side panel 32 is then folded about its fold line so as to overlay the folded third side panel 33 and is maintained in a taut condition in that position by means of the detachable fastening means (not shown). The first side panel 31 is then folded about its respective fold line so as to overlay the folded second side panel 32 and is maintained in the taut condition in that overlying position by means the detachable fastening means (not shown). Because the various side panels are in a taut condition, they form a compact pile which can be wound about the roller. The securing and tucking flaps at the inner edges of the first and second side panels can then be wrapped around the roller and placed in position.

Figure 8:
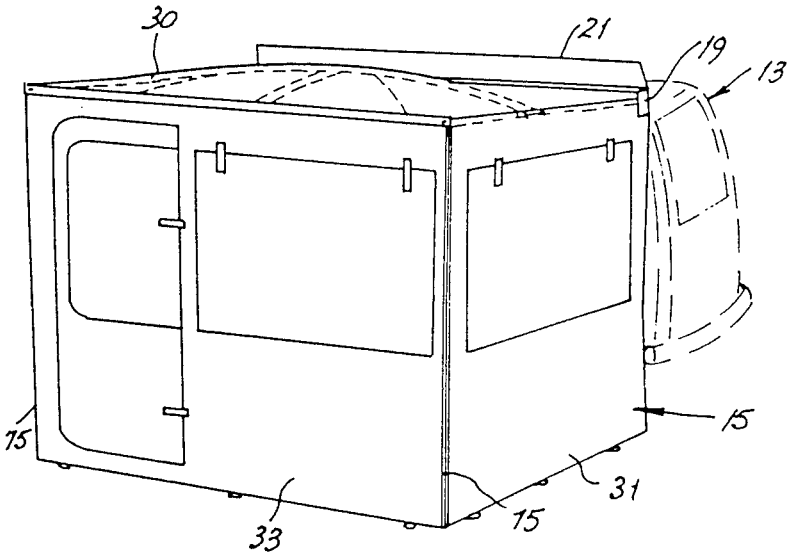
FIG. 8 is a perspective view of the shelter in the fully erected condition.
Figure 7:
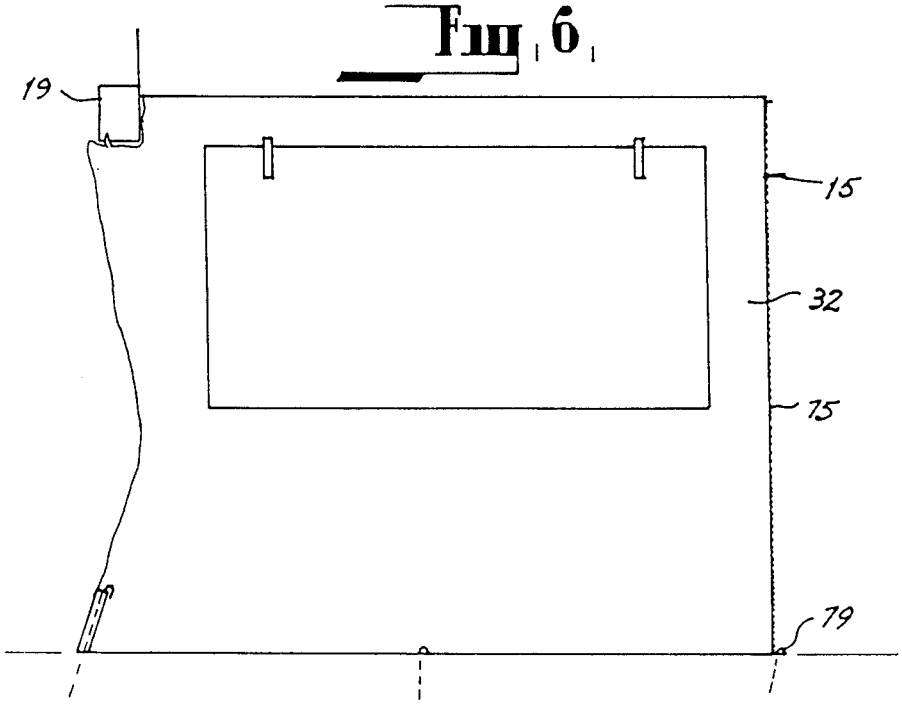
FIG. 7 is a view similar to FIG. 6 with the exception that the shelter is shown in the fully erected condition.

Zip fasteners 75 are fitted to the side edges 33*a* and 33*b* of the third side panel 33 and the adjacent side edges of the first and second side panels to permit the side panels to be detachably interconnected at their adjacent edges when in an operative (folded-down) condition (as shown in FIGS. 7 and 8).

The bottom edges of the first, second and third side panels have loops 77 to receive ground pegs 79.

The various parts of the frame structure of the shelter can be stored in the compartment with the folded flexible covering wound upon the roller. In the connection, the elongate roof members 57 and support poles 59 are shown in FIG. 2 stored in the compartment.

Figure 4:
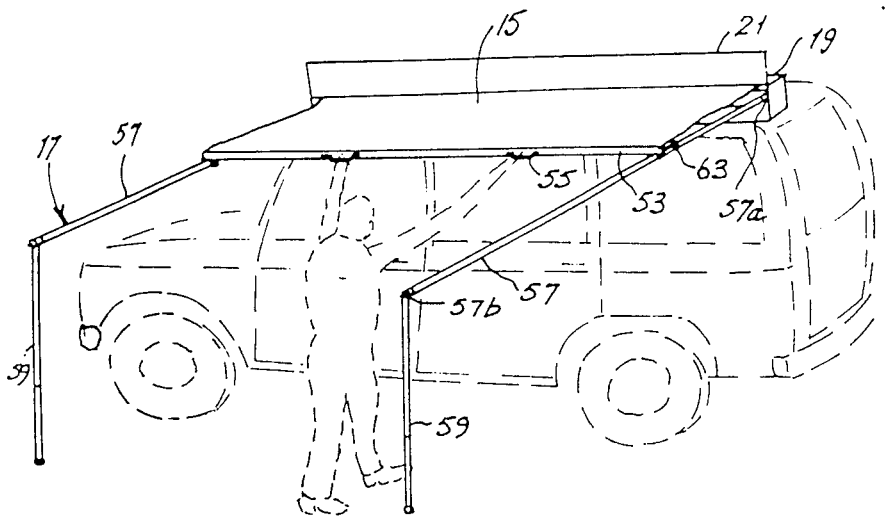
FIG. 4 is a perspective view of the shelter at one stage of erection thereof.
Figure 5:
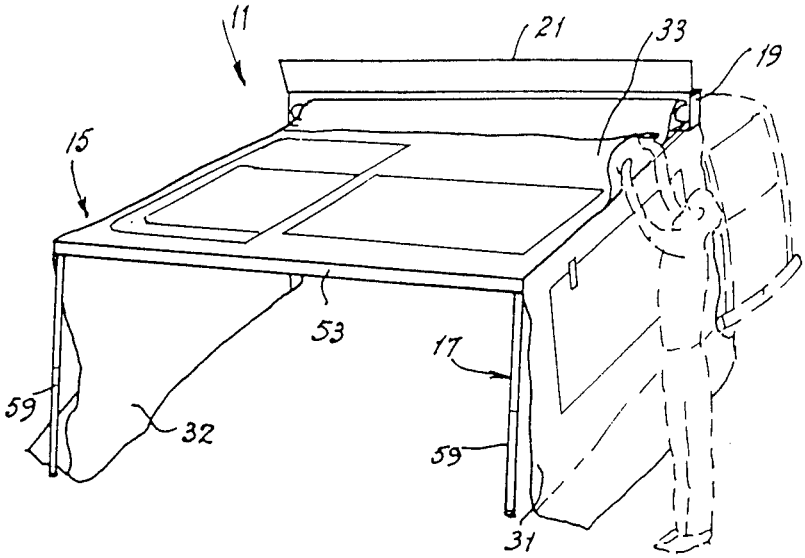
FIG. 5 is a perspective view of the shelter at a further stage of erection thereof.

Erection of the shelter will now be described. The motor vehicle 13 is parked at a site which is suitable for the shelter. The hinged cover 21 for the housing 19 is lifted and the various parts of the frame structure are removed therefrom. The inner end of the elongate roof members 57 are fitted onto the pivotal spigots 60. The poles 59 are connected to the outer ends of the elongate roof members 57 and are positioned so as to support the elongate roof members. The length of each pole 59 is adjusted so that the elongate roof members are inclined downwardly and outwardly, as illustrated in FIG. 4 of the drawings. Because of the downward inclination of the elongate roof members, the roof of the shelter is readily accessible during subsequent stages of the erection operation. The handles 55 are then gripped and the flexible covering 15 wound about the roller 27 is then moved from the retracted condition (as shown in FIG. 2) towards the fully extended condition (as shown in FIG. 5). During this operation, the engaging members 63 engage the track constituted by the elongate roof members 57 and guide the flexible covering therealong. On arriving at the free ends of the elongate roof members, the depending portions 73 of the engaging members 63 drop over the outer ends of the roof members and each assumes a position in which the respective latch pin 69 is received in the latch aperture 71. The latch pins 69 serve to retain the flexible covering in the extended condition against the return force exerted on it by the roller.

The hinged portion 25 on the underside of the housing 19 is then swung downwardly to provide access to the underside of the roller 27. The securing 41 and 43 flaps which respectively secure the first and second side panels to the roller are then detached from the roller and the tucking flaps are untucked from the regions between the roof panel and the roller. The first side panel 31 is then unclipped from its position overlying the second side panel 32 and folded down about its respective fold line into a position in which it forms one of the side walls of the shelter. Likewise, the second side panel 32 is unclipped from its position in which it overlies the third side panel 33 and is then folded down about its respective fold line into a position in which it forms the other side wall of the shelter. This stage of the erection operation is illustrated in FIG. 5 of the drawings. The third side panel 33 is next unclipped from its position overlying the roof panel 30 and is folded down about its respective fold line into a position in which it forms the front wall of the shelter. The poles 59 are then extended so as to bring the roof of the shelter into a generally horizontal position.

Each side edge of the third side panel 33 is then fastened to the adjacent side edge of the first and second side panels respectively by means of the zip fasteners 75. The loops 77 at the bottom edges of the first, second and third side panels receive ground pegs 79 which are embedded in the ground to secure the shelter in position.

Figure 9:
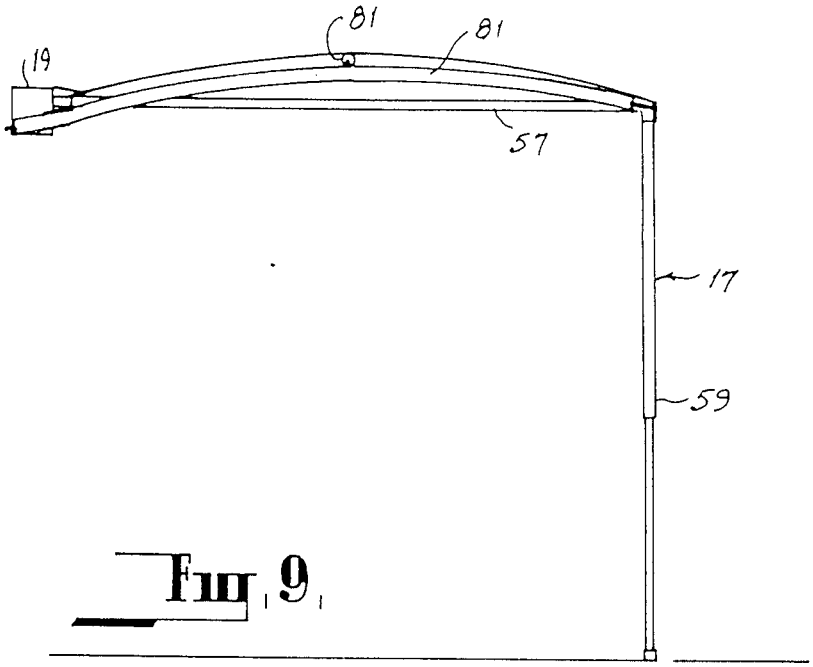
FIG. 9 is a side elevational view of the form structure in the assembled condition, the flexible covering being omitted for the sake of clarity.
Figure 10:
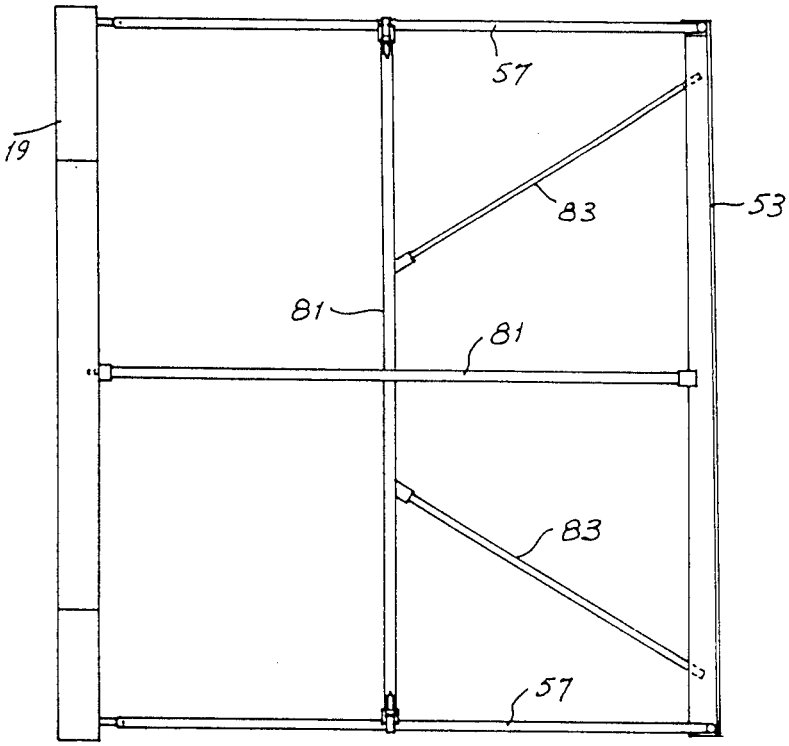
FIG. 10 is a plan view of the frame structure shown in FIG. 9.
Figure 11:
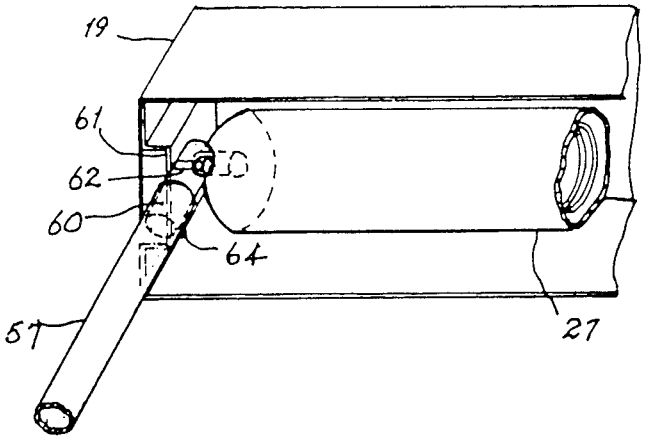
FIG. 11 is a detailed view at one end of an elongate roof member of the frame structure.

A pitch is established in the roof of the shelter so that the roof may shed water. The pitch is formed by a pair of bridging poles 81 which are installed in the frame structure of the tent, one extending between the elongate roof members and the other extending between the housing and the bracing element at the leading edge of the roof panel. Each bridging pole 81 is of a length greater than the space which it spans; in this way, the bridging pole bows when in position. Each bowed bridging pole is positioned so that its midpoint is uppermost (as shown in FIG. 9) thereby to establish the pitch in the roof. The bridging poles are releasably secured to each other at the point at which they cross and also to the parts which support their respective ends. Further bracing elements 83 may be fitted between the bridging poles 81 and the frame structure to provide additional support for the roof in adverse weather conditions, particularly in heavy rain.

A ground sheet (not shown) may be used to cover the ground within the shelter if desired and is preferably attached to the three side panels by means of zip fasteners or other suitable means. The ground sheet may incorporate an upstanding portion which locates adjacent the motor vehicle so as to close the space between the body of the motor vehicle and the ground surface, thereby to exclude draughts and to increase privacy.

Dismantling of the shelter is essentially the reverse of the erection procedure. In the dismantling operation, the inner edges of the first and second side panels are secured to the roller in the manner described hereinbefore prior to winding the folded flexible covering onto the roller. In this connection, the securing flap and tucking flap of the second side panel are first installed in position and thereafter the securing flap and tucking flap of the first side panel (which is the uppermost panel in the folded pile) are installed in position. This assists the flexible covering to wind onto the roller in a compact condition. The guidance provided by the engaging members sliding on the track also assists in this respect.

Although the invention has been described with reference to one specific embodiment thereof it is not limited thereto and various modifications and alterations may be made without departing from the scope of the invention. For instance, the invention is not limited in application to a shelter in the form of an annexe for motor vehicles and may equally be used as a shelter for caravans, camping trailers and other vehicles. In addition, the shelter may be attached to dwellings and other buildings. Furthermore, the shelter may be used as a stand alone unit.

I claim:

1. A collapsible shelter carried by a supporting structure adapted to be mounted on a base such as a motor vehicle, said collapsible shelter comprising a roller journaled on said supporting structure, a roof panel of flexible material secured at one end of said roof panel to the roller and windable upon said roller for storage and unwindable from said roller to extend outwardly of the support structure and define a roof, guide means for guiding said roof panel while being wound upon and from said roller, said guide means includes a track means comprised of a pair of spaced apart track elements and a pair of engaging means each provided on said roof panel adjacent an outer edge thereof, the track means having a collapsed condition and an erected condition wherein said track means extends outwardly of said roller from one side of said supporting structure, said engaging means being engagable with said track elements for guided movement therealong when said track means is in the erected condition thereby to guide said roof panel while being wound upon and from the roller, said track means being angularly adjustable when in the erected condition for facilitating selective variation of the vertical position of the end thereof remote from said roller.

2. A collapsible shelter according to claim 1 further comprising a collapsible frame structure for erection immediately adjacent said supporting structure, the collapsible frame structure when erected supporting the roof panel when unwound from the roller, said track elements being comprised of a pair of elongate roof support members forming part of said frame structure.

3. A collapsible shelter according to claim 2 wherein the outer end of each elongate roof support member is supported when erected by a respective support pole forming part of the frame structure, the poles being adjustable in length.

4. A collapsible shelter according to claim 2 wherein the inner end of each elongate roof support member is detachably connectable to a pivot means located adjacent the roller to permit angular movement of the roof support member.

5. A collapsible shelter according to claim 1 wherein the engaging means comprises a pair of engaging members to each slidably engage one of the elongate roof support members.

6. A collapsible shelter according to claim 1 wherein an elongate bracing element is attached to the outer end of the roof panel thereby to provide lateral rigidity thereto.

7. A collapsible shelter according to claim 1 further comprising a side panel of flexible material attached to an edge of the roof panel, said side panel being movable between stowed and operative positions wherein in the stowed positions said side panel lays in face-to-face relation with the roof panel and wherein in the operative position said side panel provides a side wall.

8. A collapsible shelter according to claim 7 wherein the inner edge of the side panel is provided with a securing flap adapted to be wrapped about the roller and releasably fixed thereto when said side panel is in the stowed position.

9. A collapsible shelter according to claim 8 wherein the inner edge of the side panel is further provided with a tucking flap adapted to be wrapped about the roller and tucked into the region between the roller and the roof panel.

10. A collapsible shelter according to claim 7 wherein the side panel is detachably securable to the roof panel when in the stowed position so as to maintain the side panel in face-to-face relation with the roof panel during winding upon and unwinding from the roller.

11. A collapsible shelter according to claim 7 further comprising at least one further side panel movable between stowed and operative positions, the first-mentioned side panel occupying an uppermost position when in the stowed condition.

12. A collapsible shelter according to claim 3 wherein the inner end of each elongate roof support member is detachably connectable to a pivot means located adjacent the roller to permit angular movement of the roof support member.

* * * * *